US010830192B2

(12) United States Patent
Petronio

(10) Patent No.: US 10,830,192 B2
(45) Date of Patent: Nov. 10, 2020

(54) SYSTEM FOR RECIRCULATING BLOW-BY GASES INTO AN INTAKE DUCT OF AN INTERNAL COMBUSTION ENGINE, THE SYSTEM HAVING AN ANTI-ICING DEVICE

(71) Applicant: FCA Italy S.p.A., Turin (IT)

(72) Inventor: Domenico Petronio, Trofarello (IT)

(73) Assignee: FCA Italy S.p.A., Turin (IT)

( * ) Notice: Subject to any disclaimer, the term of this patent is extended or adjusted under 35 U.S.C. 154(b) by 149 days.

(21) Appl. No.: 15/907,879

(22) Filed: Feb. 28, 2018

(65) Prior Publication Data

US 2018/0372037 A1 Dec. 27, 2018

(30) Foreign Application Priority Data

Jun. 21, 2017 (EP) ..... 17177057

(51) Int. Cl.
*F02M 35/08* (2006.01)
*F01M 13/04* (2006.01)
(Continued)

(52) U.S. Cl.
CPC ..... *F02M 35/088* (2013.01); *F01M 13/022* (2013.01); *F01M 13/04* (2013.01);
(Continued)

(58) Field of Classification Search
CPC .. F01M 13/0011; F01M 13/022; F01M 13/04; F01M 2013/0027; F01M 2013/027;
(Continued)

(56) References Cited

U.S. PATENT DOCUMENTS 4,366,798 A * 1/1983 Goto ..... F02M 31/135 123/545
2001/0047801 A1* 12/2001 Baeuerle ..... F01M 11/10 123/574

(Continued)

FOREIGN PATENT DOCUMENTS

CN 105370454 A 3/2016
EP 2245279 11/2010

(Continued)

OTHER PUBLICATIONS

European Patent Office, Extended European Search Report for EP 17177057.1 dated Dec. 7, 2017, 3 pages.

*Primary Examiner* — Hung Q Nguyen
*Assistant Examiner* — Ruben Picon-Feliciano
(74) *Attorney, Agent, or Firm* — Heslin Rothenberg Farley & Mesiti P.C.; Victor A. Cardona, Esq.

(57) ABSTRACT

A system for recirculating blow-by gases into an air intake duct of an internal combustion engine, includes a separating device to separate oil, in a flow of blow-by gases of the engine. The separator device has an inlet for receiving blow-by gases, at least one discharge for returning the oil separated to the engine, and an outlet for clean blow-by gases. A recirculation duct connects the outlet to an air intake duct of the engine. The recirculation duct has an end connected to the intake duct by a T-connector member, with a main duct portion arranged along the intake duct and a tubular element protruding inside the main duct portion. The tubular element protruding inside the main duct portion has an annular end surface that has an irregular profile, preferably in the form of a saw-like toothed profile.

11 Claims, 4 Drawing Sheets

Figure 1:
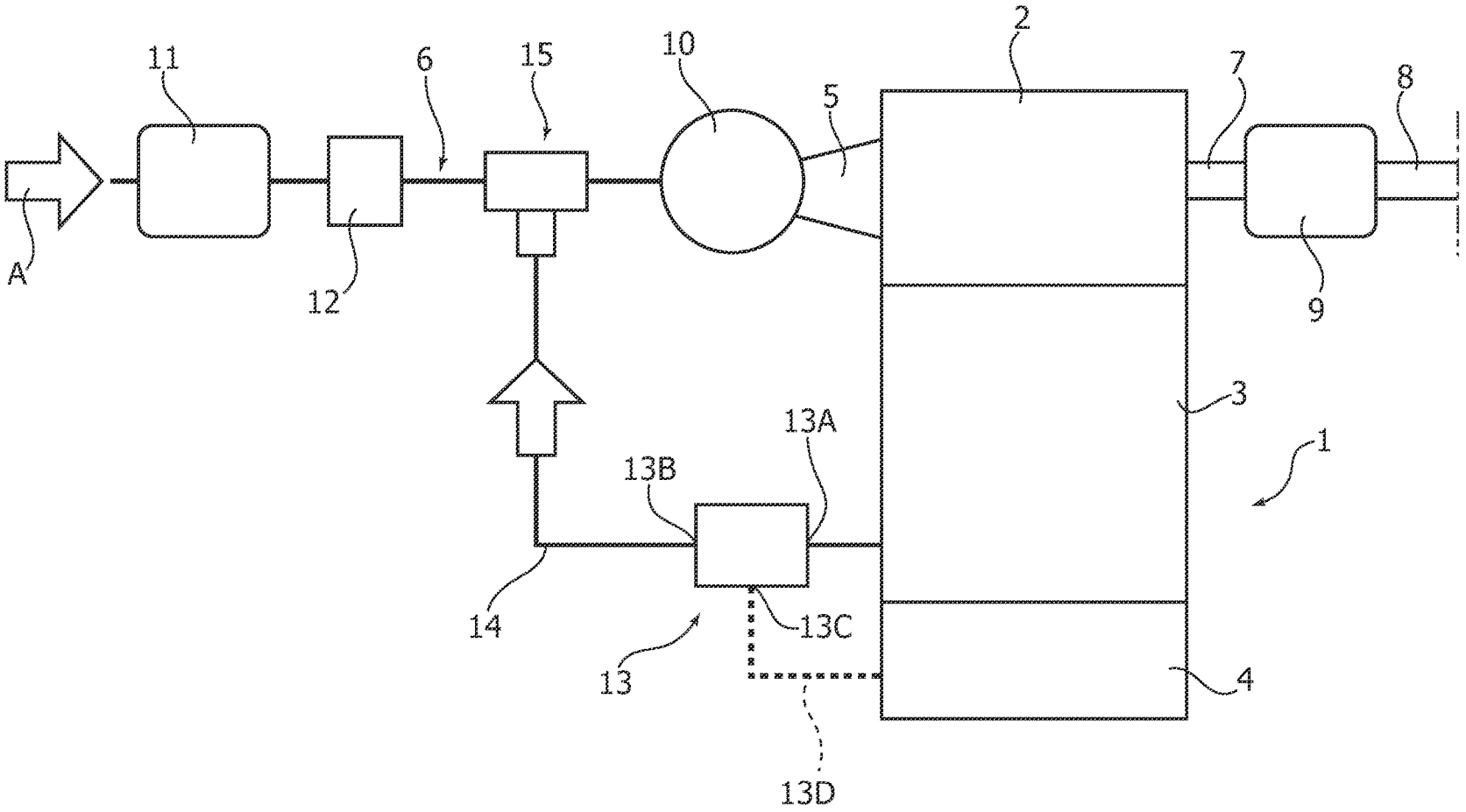

(51) Int. Cl.
*F02M 35/10* (2006.01)
*F01M 13/02* (2006.01)
*F01M 13/00* (2006.01)

(52) U.S. Cl.
CPC *F02M 35/10091* (2013.01); *F02M 35/10222* (2013.01); *F01M 13/0011* (2013.01); *F01M 2013/0027* (2013.01); *F01M 2013/027* (2013.01); *F01M 2013/0455* (2013.01); *F02M 35/10157* (2013.01)

(58) Field of Classification Search
CPC ..... F01M 2013/0455; F02M 35/088; F02M 35/10091; F02M 35/10157; F02M 35/10222; F02M 35/10118; F02M 35/10124; F02M 35/10131; F02M 35/10137; F02M 35/10144; F02M 35/10255
See application file for complete search history.

(56) References Cited

U.S. PATENT DOCUMENTS

2011/0120397 A1* 5/2011 Velosa ..... F01M 13/022 123/41.86
2011/0209772 A1* 9/2011 Woiken ..... B01F 5/0428 137/15.01

FOREIGN PATENT DOCUMENTS

| | | | |
|---|---|---|---|
| EP | 2390477 | A1 | 11/2011 |
| EP | 2653678 | A1 | 10/2013 |
| JP | 2012215137 | A | 11/2012 |
| WO | 2017075390 | A1 | 5/2017 |

* cited by examiner

FIG. 2A
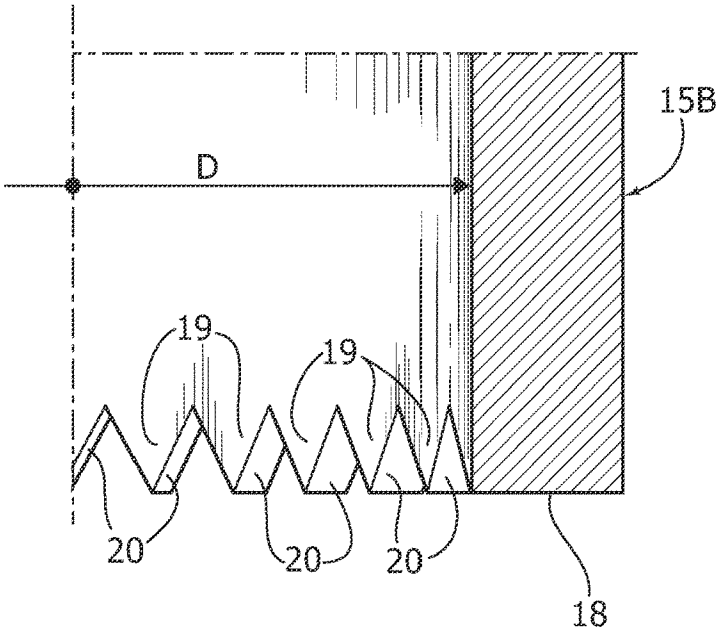
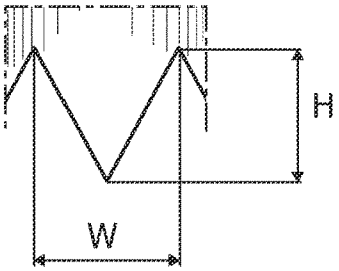
FIG. 2B
FIG. 2
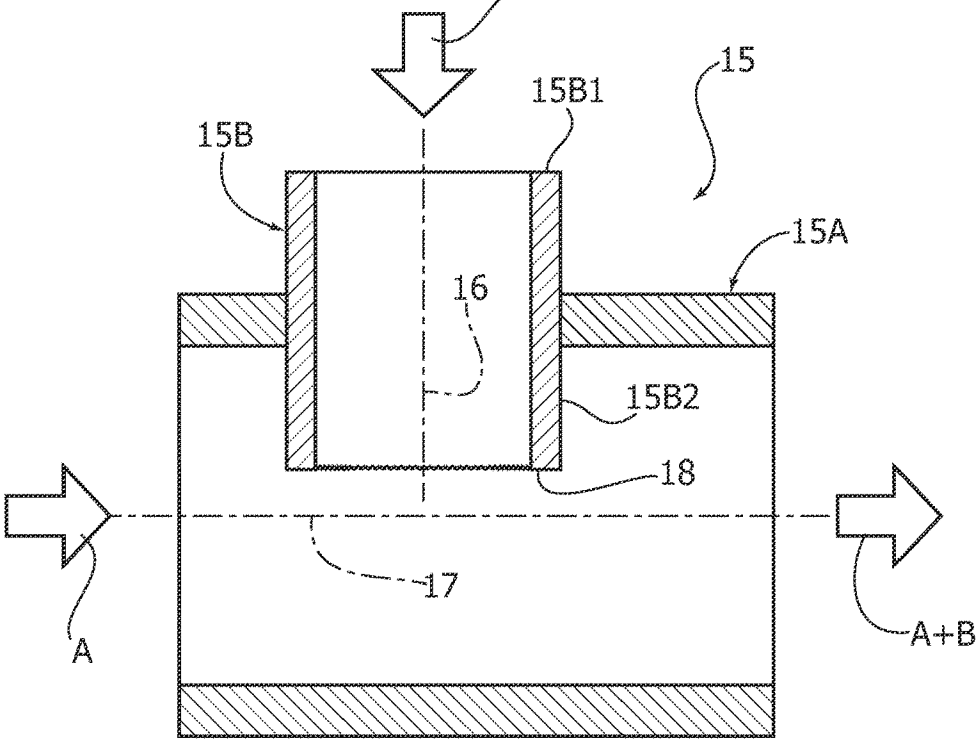

SYSTEM FOR RECIRCULATING BLOW-BY GASES INTO AN INTAKE DUCT OF AN INTERNAL COMBUSTION ENGINE, THE SYSTEM HAVING AN ANTI-ICING DEVICE

CROSS REFERENCE TO RELATED APPLICATIONS

This application claims priority to European Application No. 17177057.1, filed on Jun. 21, 2017, the entire disclosure of these applications being hereby incorporated herein by reference.

FIELD OF THE INVENTION

The present invention relates to systems for recirculating blow-by gases into an intake duct of an internal combustion engine, in particular of a motor-vehicle engine. The invention relates, in particular, to a system for recirculating blow-by gases of a known type, comprising:

- a separating device, configured for separating oil, in the form of vapor or droplets, contained in blow-by gases of an internal combustion engine, said separating device having an inlet for receiving blow-by gases from the engine, at least one discharge for returning the separated oil to the engine in said separating device, and an outlet for the clean blow-by gases,
- a recirculation duct connecting said outlet for the clean blow-by gases from the separator device with an air intake duct of said internal combustion engine, said recirculation duct having an end connected to said intake duct by means of a T-connector member, having a main duct portion arranged along said intake duct and a tubular element, also called "snorkel", having an essentially transversal axis with respect to the axis of said main duct portion,
- wherein said tubular element has a first end connected to said recirculation duct and a second end protruding inside said main duct portion.

PRIOR ART

In internal combustion engines, the blow-by gases that trawl through the clearance between pistons and cylinders of the engine, passing from the cylinders to the engine crankcase, are recirculated to the engine intake after the oil is separated and carried into the crankcase of the engine, which is mixed with the blow-by gases in the form of vapor and/or droplets. The task of the separator device is to allow recirculation of the blow-by gases into the air supply system to the engine, while preventing liquid particles from entering the intake system. Separator devices of the type indicated above are described and illustrated, for example, in the documents EP 2 390 477 A1 and EP 2 653 678 A1, owned by the same Applicant.

When a motor-vehicle equipped with a blow-by gas recirculation system of the above-mentioned type is used at temperatures close to or less than 0° C., there may be ice accumulations around said second end of said tubular element or snorkel, through which the clean blow-by gases are recirculated into the intake duct of the engine. Ice formation is caused by the presence of moisture (water) in the flow of air fed into the intake duct of the engine and/or in the blow-by gas flow. The amount of ice is correlated to the moisture content, the temperature of the air and of the blow-by gases, as well as to the pressure and velocity of the flows of air and gases. If the amount of ice is excessive, it may possibly partially or completely block the passage for recirculating blow-by gases, resulting in a decline in engine performance and with the risk, in extreme cases, of damage to the engine.

A system as set forth in the preamble of claim 1 is known from EP 2 245 279 A1. Similar solutions are known from US 2011/120397 A1, JP 2012 215137 A, CN 105 370 454 A and WO 2017/075390 A1.

OBJECT OF THE INVENTION

The object of the present invention is that of efficiently overcoming the aforesaid drawback, at the same time using simple and inexpensive means.

SUMMARY OF THE INVENTION

In view of achieving the aforesaid object, the present invention relates to a system for recirculating blow-by gases having all the characteristics indicated in claim 1. In a preferred embodiment, the saw-like toothed profile includes a plurality of pointed tooth protruding axially and defining between them a plurality of compartments with pointed bottoms.

Thanks to the aforesaid characteristics, the recirculation system according to the present invention is able to easily and efficiently overcome the risk of ice formations, which would undermine the correct functioning of the system.

The irregular profile of the annular end surface of the aforesaid tubular element, through which the clean blow-by gases recirculate into the intake duct of the engine, creates discontinuities in the ice formations, which cause these formations to weaken, with the result that they are drastically limited or even completely blocked.

Another advantage of the aforesaid irregular profile of the annular end surface of the tubular element for recirculating the blow-by gases lies in the fact that this uneven profile creates turbulence in the flows of air and blow-by gases, resulting in improved mixing of these flows. Moreover, the irregular profile allows improvement of the field of fluid-dynamic motion within the ducts, thus increasing the depression in the confluence area of the blow-by gases into the intake air flow, resulting in an increase in the suction effect to which the blow-by gases are subjected.

The shape (height and width), the number, and the position of the teeth of the aforesaid irregular profile are chosen according to each specific application. The same applies to the diameter, the height, and the inclination of the portion of said tubular element or snorkel that protrudes inside the main duct portion in which the intake air flows.

Studies and investigations by the Applicant have shown that it is preferable, in any case, that the height/width ratio of each tooth of the irregular profile is between 0.2 and 5, and that the ratio between the width of each tooth of the aforesaid irregular profile and the inner diameter of the aforesaid tubular element or snorkel is between 5 and 50. It is also preferable that the height of each tooth of the irregular profile is between 0.1 and 10 mm.

DESCRIPTION OF A PREFERRED EMBODIMENT OF THE INVENTION

Figure 3:
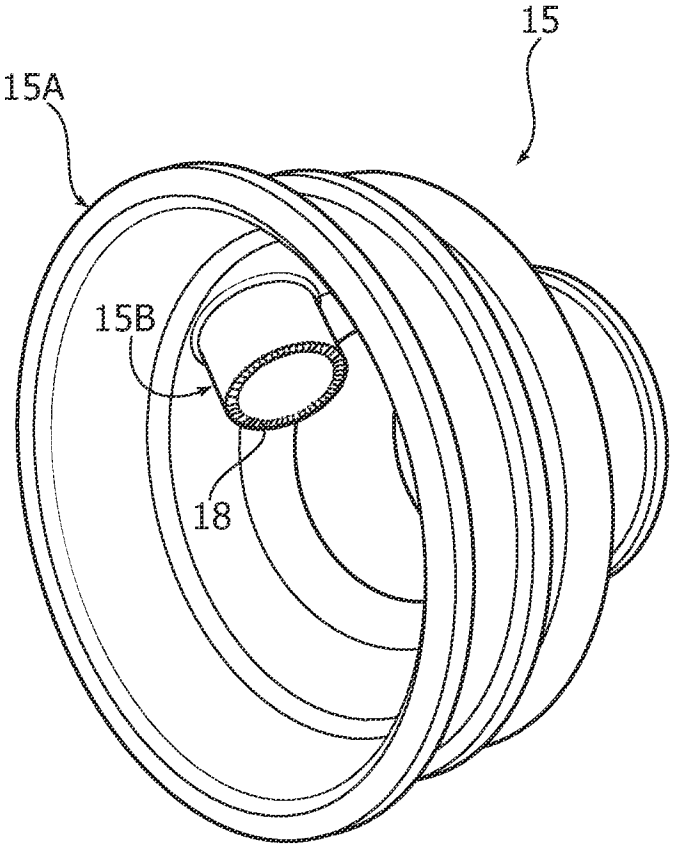
Figure 5:
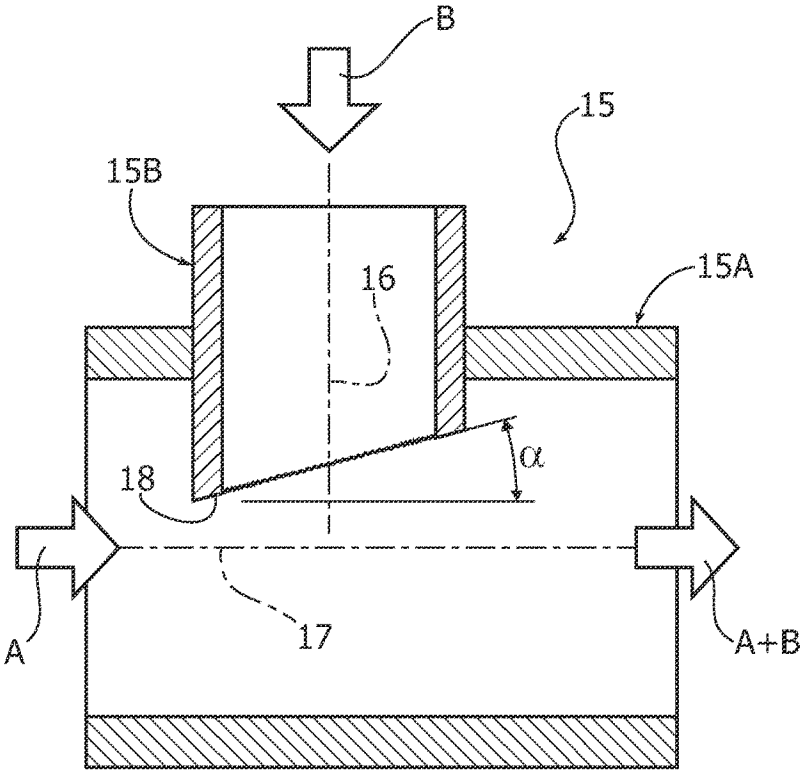
Figure 4:
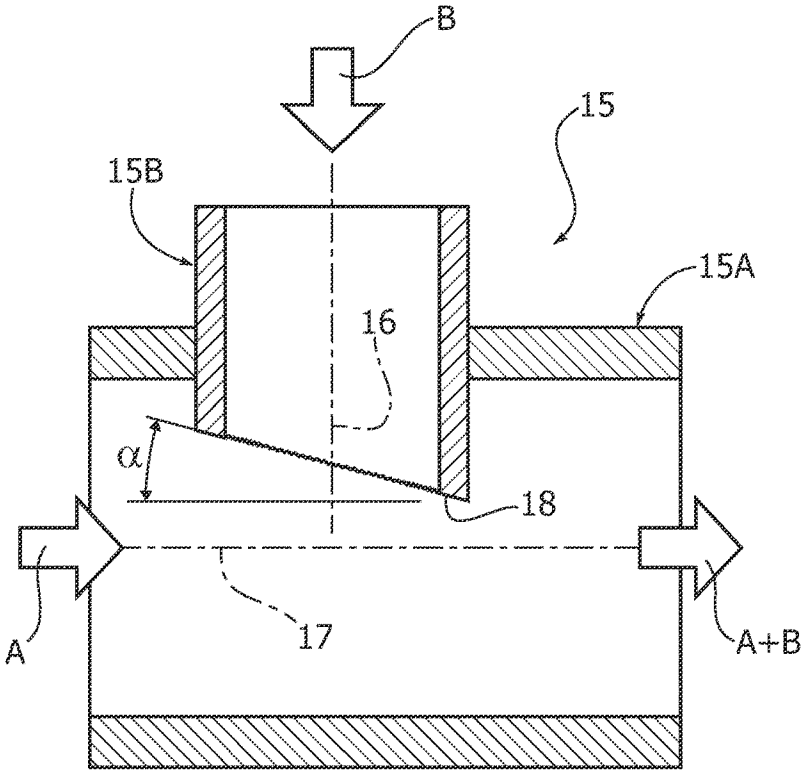

Further characteristics and advantages of the invention will become apparent from the description that follows with reference to the attached drawings, provided purely by way of non-limiting example, wherein:

FIG. 1 is a schematic diagram of a system for recirculating blow-by gases into an air intake duct of an internal combustion engine of a motor-vehicle, FIG. 2 is a schematic cross-sectional view of a T-connector element for recirculating blow-by gases into the intake duct, FIGS. 2A and 2B are views, on an enlarged scale, of a detail of FIG. 2, FIG. 3 is a perspective view of a concrete embodiment of the T-connector element of the system according to the invention, and FIGS. 4 and 5 illustrate two variants of FIG. 2.

With reference to FIG. 1, numeral 1 indicates an internal combustion engine of a motor-vehicle, which in the example illustrated is a supercharged engine. The engine 1 comprises a cylinder head 2, a base 3, and an oil sump 4. All components of the internal combustion engine, as well as the remaining components of the system of recirculating blow-by gases, are shown in FIG. 1 in a schematic way, since each of these components can be produced in any way known in itself, and also as these components, taken in themselves, are not the object of the present invention. Eliminating the construction details from FIG. 1 also makes the design simpler and more comprehensible.

An intake manifold 5 is associated with the cylinder head 2, which receives the air flow passing through an air intake duct 6, and feeds this air flow to the cylinders of the engine (not shown in the drawing). The cylinder head 2 is also associated with an exhaust manifold 7, through which the exhaust gases leaving the engine cylinders are conveyed into a duct 8 for the exhaust gases, which conducts the gases to an exhaust gas treatment device (not visible in the drawing). In the case of the illustrated example, a turbine 9 is provided in the exhaust gas duct 8 for driving a supercharger compressor 10, interposed in the intake duct 6, upstream of the intake manifold 5. Of course, these components are illustrated herein with reference to a particular embodiment, since it is evident that the invention is applicable to any type of engine, even non-supercharged engines. Still according to a conventional technique, in the air intake duct 6, upstream of the compressor 10, an air filter 11 and a butterfly valve 12 are interposed. The specific configuration of these components, as well as the butterfly valve control system, are not described or illustrated here, since they can be produced in any known way.

Still with reference to FIG. 1, numeral 13 indicates, in its entirety, a separator device used to remove oil particles contained in a flow of blow-by gases before they are recirculated into the intake duct 6 of the engine. Blow-by gases that trawl through the clearance between pistons and cylinders of the engine passing into the lower part of the engine base 3 are conveyed to an inlet 13A of the separating device 13, which communicates with the inner cavity of the base 3. As indicated above, the specific configuration of the separator device 13 can be of any known type. For example, separating devices of the type shown in the documents EP 2 390 477 A1 and EP 2 653 678 A1 can be used. Sill in accordance with the prior art, the separating device 13 comprises an outlet 13B for clean blow-by gases and a discharge 13C, through which the oil particles separated from the separating device 13 return through a line 13D into the oil sump 4 of the engine.

The outlet 13B of the clean blow-by gases is connected to the air intake duct 6 by means of a blow-by gas recirculation duct 14, which flows into the intake duct 6 by means of a T-connector member, indicated in its entirety by 15.

With reference to FIG. 2, the T-connector member 15 comprises a main duct portion 15A, which is inserted into the air intake duct 6 so as to receive the flow A of the intake air coming from the intake duct 6. The connector member 15 also includes a tubular element, called also "snorkel", 15B, having a first end 15B1 connected to the recirculation duct 14 of the blow-by gases (not illustrated in FIG. 2) and a second end 15B2, which protrudes inside the main duct portion 15A, with a relatively long length portion, at least equal to 30-40% of the inner diameter of the main duct portion 15A.

The axis 16 of the tubular element or snorkel 15B is generally essentially transverse to the axis 17 of the main duct portion 15A. In the illustrated example, the axes 16, 17 are orthogonal to each other and reciprocally incident. However, it is also possible to provide the axes 16, 17 wherein they form an angle other than 90°. Still in the case of the example illustrated in FIG. 2, the annular end surface 18 of the tubular element or snorkel 15B, which is facing inside the main duct portion 15A, is contained in a plane orthogonal to the axis 16 of the tubular element 15B. However, it is possible to provide this plane so that it is inclined with respect to a plane orthogonal to the axis 16. FIGS. 4, 5 show two examples in which the plane of the annular end surface 18 is inclined with respect to a plane orthogonal to the axis 16, so as to form an angle $\alpha$ with this plane. In the case of the embodiment of FIG. 4, the inclination is such so that the annular end surface 18 faces towards the upstream end of the main duct portion 15A, while the embodiment of FIG. 5 shows an annular end surface 18 that faces towards the downstream end of the main duct portion 15A.

In FIGS. 2, 4 and 5, the arrow B indicates the flow of blow-by gases that crosses the tubular element or snorkel 15B. The air flow A is mixed with the flow of blow-by gases B inside the main duct portion 15A, resulting in a flow A+B, which is fed to the engine cylinders. The air flow A through the main duct portion creates a depression in the confluence area of the snorkel 15B, which sucks the flow B of blow-by gases inside the air flow A.

One important characteristic of the present invention lies in the fact that the aforesaid annular end surface 18 of the tubular element or snorkel 15B has an irregular profile, which in the illustrated embodiment is formed of a plurality of pointed teeth 19, projecting axially and defining between them compartments with pointed bottoms 20.

As discussed above, the irregular profile defined by the teeth 19 creates an anti-ice function, as it completely or partially prevents the formation of ice caused by the freezing of water particles contained in the air flow A and/or the flow of blow-by gases B at low temperatures. The teeth 19 create discontinuities in the ice formations, thus weakening these formations or preventing them altogether.

Another advantage deriving from the irregular profile of the annular end surface 18 lies in the fact that it gives rise to a turbulence in the flows A and B of air and blow-by gases, which improves the mixing of these flows while, at the same time, optimizing the field of fluid-dynamic motion so as to increase the local depression and the resulting suction effect to which the blow-by gases are subjected.

The height H and the width W (FIG. 2B) of each tooth 19, the number of teeth 19 and the position of the teeth 19 are chosen according to each specific application. The same applies to the diameter, height, inclination and the position of the part of the tubular element or snorkel 15B protruding inside the main duct portion 15A.

Studies and investigations of the Applicant have shown that it is particularly preferable if the H/W ratio between the height and width of each tooth 19 is between 0.2 and 5, and that the ratio between the inner diameter D of the tubular element or snorkel 15B and the width W of each tooth 19 is between 5 and 50. Furthermore, the height H of each tooth 19 is preferably between 0.1 and 10 mm.

FIG. 3 shows a concrete embodiment of the T-connector member 15, with the main duct portion 15A and the tubular element or snorkel 15B protruding inside the main duct portion 15A.

The constructive design of the T-connector member 15 can, of course, be made in any preferred manner. In particular, the tubular element or snorkel 15B can be formed of a separate body with respect to the main duct portion 15A, which is inserted through an opening formed in the wall of the main duct portion and welded to said wall. Alternatively, the two elements 15A, 15B can also be produced in a single body. Additionally, the T-connector member can be made by a separate element with respect to other components or can be integrated, as a whole or in part, into other components, for example, in an inlet connection of the compressor 10.

More generally, without prejudice to the principle of the invention, the details of construction and the embodiments may vary widely with respect to those described and illustrated, without departing from the scope of the present invention, as defined in the attached claims.

What is claimed is:

1. A system for recirculating blow-by gases into an air intake duct of an internal combustion engine, comprising:

a separating device, configured for separating oil, in the form of vapor or droplets, from blow-by gases of an internal combustion engine, said separating device having an inlet to receive blow-by gases from the engine, at least one discharge for returning the oil separated in said separating device to the engine and an outlet for clean blow-by gases, a recirculation duct that connects said outlet for the clean blow-by gases from the separator device to an air intake duct of said internal combustion engine, said recirculation duct having an end connected to said intake duct by means of a T-shaped connector member, having a main duct portion arranged along said intake duct and a tubular element having a transversal axis with respect to the axis of said main duct portion, wherein said tubular element has a first end connected to said recirculation duct and a second end protruding inside said main duct portion, and said second end of said tubular element protruding inside said main duct portion by a length at least equal to 30% of the inner diameter of the main duct portion, and having an annular end surface which has an irregular profile formed as a saw-like toothed profile, including a plurality of teeth having longitudinal dimensions aligned axially and protruding axially from the annular end surface of said tubular element, relative to an axial dimension of said tubular element, along an entire circumference of said annular end surface; and wherein said second end has a first side circumferential point and a second side circumferential point, said first side circumferential point being closer to said main duct portion relative to said second side circumferential point and further from a duct axis of said main duct portion relative to said second side circumferential point.

2. A system according to claim 1, wherein said saw-like toothed profile includes a plurality of pointed teeth projecting axially, and defining a plurality of compartments with pointed bottoms.

3. The system of claim 1 wherein said tubular element has an interior surface which is non-toothed and regular compared to said second end.

4. The system of claim 1 wherein said tubular element consists of a single walled pipe.

5. The system of claim 1 wherein said second end has end surface parallel to said axis.

6. The system of claim 1 wherein said second end has end surface non-parallel to said axis.

7. The system of claim 1 wherein said second end has end surface inclined relative to said axis.

8. A system for recirculating blow-by gases into an air intake duct of an internal combustion engine, comprising:

a separating device, configured for separating oil, in the form of vapor or droplets, from blow-by gases of an internal combustion engine, said separating device having an inlet to receive blow-by gases from the engine, at least one discharge for returning the oil separated in said separating device to the engine and an outlet for clean blow-by gases, a recirculation duct that connects said outlet for the clean blow-by gases from the separator device to an air intake duct of said internal combustion engine, said recirculation duct having an end connected to said intake duct by means of a T-shaped connector member, having a main duct portion arranged along said intake duct and a tubular element having a transversal axis with respect to the axis of said main duct portion, wherein said tubular element has a first end connected to said recirculation duct and a second end protruding inside said main duct portion, said second end of said tubular element protruding inside said main duct portion by a length at least equal to 30% of the inner diameter of the main duct portion, and having an annular end surface which has an irregular profile in form of a saw-like toothed profile, including a plurality of teeth protruding axially from the annular end surface of said tubular element, along the entire circumferential extension of said annular end surface, and wherein a ratio between height and width of each tooth of said saw-like toothed profile is between 0.2 and 5.

9. A system for recirculating blow-by gases into an air intake duct of an internal combustion engine, comprising:

a separating device, configured for separating oil, in the form of vapor or droplets, from blow-by gases of an internal combustion engine, said separating device having an inlet to receive blow-by gases from the engine, at least one discharge for returning the oil separated in said separating device to the engine and an outlet for clean blow-by gases, a recirculation duct that connects said outlet for the clean blow-by gases from the separator device to an air intake duct of said internal combustion engine, said recirculation duct having an end connected to said intake duct by means of a T-shaped connector member, having a main duct portion arranged along said intake duct and a tubular element having a transversal axis with respect to the axis of said main duct portion, wherein said tubular element has a first end connected to said recirculation duct and a second end protruding inside said main duct portion, said second end of said tubular element protruding inside said main duct portion by a length at least equal to 30% of the inner diameter of the main duct portion, and having an annular end surface which has an irregular profile in form of a saw-like toothed profile, including a plurality of teeth protruding axially from the annular end surface of said tubular element, along the entire circumferential extension of said annular end surface, and wherein a ratio between the inner diameter of said tubular element and the width of each tooth of said saw-like toothed profile is between 5 and 50.

10. A system for recirculating blow-by gases into an air intake duct of an internal combustion engine, comprising:

a separating device, configured for separating oil, in the form of vapor or droplets, from blow-by gases of an internal combustion engine, said separating device having an inlet to receive blow-by gases from the engine, at least one discharge for returning the oil separated in said separating device to the engine and an outlet for clean blow-by gases, a recirculation duct that connects said outlet for the clean blow-by gases from the separator device to an air intake duct of said internal combustion engine, said recirculation duct having an end connected to said intake duct by means of a T-shaped connector member, having a main duct portion arranged along said intake duct and a tubular element having a transversal axis with respect to the axis of said main duct portion, wherein said tubular element has a first end connected to said recirculation duct and a second end protruding inside said main duct portion, said second end of said tubular element protruding inside said main duct portion by a length at least equal to 30% of the inner diameter of the main duct portion, and having an annular end surface which has an irregular profile in form of a saw-like toothed profile, including a plurality of teeth protruding axially from the annular end surface of said tubular element, along the entire circumferential extension of said annular end surface, and wherein a height of each tooth of said saw-like toothed profile is between 0.1 and 10 mm.

11. A system for recirculating blow-by gases into an air intake duct of an internal combustion engine, comprising:

a separation device, configured for separating oil, in the form of vapor or droplets, from blow-by gases of an internal combustion engine, said separating device having an inlet to receive blow-by gases from the engine, at least one discharge for returning the oil separated in said separating device to the engine and an outlet for clean blow-by gases, a recirculation duct that connects said outlet for the clean blow-by gases from the separator device to an air intake duct of said internal combustion engine, said recirculation duct having an end connected to said intake duct by means of a T-shaped connector member, having a main duct portion arranged along said intake duct and a tubular element having a transversal axis with respect to the axis of said main duct portion, wherein said tubular element has a first end connected to said recirculation duct and a second end protruding inside said main duct portion, and said second end of said tubular element protruding inside said main duct portion by a length at least equal to 30% of the inner diameter of the main duct portion, and having an annular end surface which has an irregular profile formed as a saw-like toothed profile, including a plurality of teeth having longitudinal dimensions aligned axially and protruding axially from the annular end surface of said tubular element, relative to an axial dimension of said tubular element, along an entire circumference of said annular end surface; and wherein said second end has a first side circumferential point and a second side circumferential point, said first side circumferential point being further away from said main duct portion relative to said second side circumferential point and closer to a duct axis of said main duct portion relative to said second side circumferential point.

* * * * *